US010724523B2

(12) United States Patent
Wu et al.

(10) Patent No.: US 10,724,523 B2
(45) Date of Patent: Jul. 28, 2020

(54) COMPRESSOR AND REFRIGERATION SYSTEM HAVING SAME

(71) Applicant: GREE GREEN REFRIGERATION TECHNOLOGY CENTER CO., LTD. OF ZHUHAI, Zhuhai, Guangdong (CN)

(72) Inventors: Jian Wu, Guangdong (CN); Hui Huang, Guangdong (CN); Yusheng Hu, Guangdong (CN); Huijun Wei, Guangdong (CN); Ouxiang Yang, Guangdong (CN); Sheng Chen, Guangdong (CN); Huifang Luo, Guangdong (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 255 days.

(21) Appl. No.: 16/070,938

(22) PCT Filed: Jan. 20, 2017

(86) PCT No.: PCT/CN2017/071966
§ 371 (c)(1),
(2) Date: Jul. 18, 2018

(87) PCT Pub. No.: WO2017/125079
PCT Pub. Date: Jul. 27, 2017

(65) Prior Publication Data

US 2019/0024662 A1 Jan. 24, 2019

(30) Foreign Application Priority Data

Jan. 21, 2016 (CN) ..... 2016 1 0043991

(51) Int. Cl.
*F04C 18/356* (2006.01)
*F04C 29/12* (2006.01)
(Continued)

(52) U.S. Cl.
CPC ..... *F04C 18/356* (2013.01); *F01C 21/0818* (2013.01); *F04C 23/001* (2013.01);
(Continued)

(58) Field of Classification Search
CPC .... F04C 18/356; F04C 23/001; F04C 23/008; F04C 28/02; F04C 28/06; F04C 29/12;
(Continued)

(56) References Cited

U.S. PATENT DOCUMENTS

2011/0271699 A1* 11/2011 Lee ..... F04C 23/008 62/228.4
2015/0040608 A1* 2/2015 Nam ..... F04C 15/06 62/498

FOREIGN PATENT DOCUMENTS

CN 204100662 U 1/2015
CN 104632581 A 5/2015
(Continued)

OTHER PUBLICATIONS

International Search Report for International Application No. PCT/CN2017/071966, dated May 4, 2017, 3 pages.

*Primary Examiner* — Connor J Tremarche
(74) *Attorney, Agent, or Firm* — Armstrong Teasdale LLP

(57) ABSTRACT

Provided are a compressor and a refrigeration system having the same. The compressor includes: a housing, a lower flange structure, a first compression cylinder and a second compression cylinder. The first compression cylinder includes a cylinder body, a roller and a sliding vane. A sliding vane groove is provided on an inner wall of the cylinder body. The roller is provided in the cylinder body.
(Continued)

The sliding vane is provided in the sliding vane groove and matched with the roller. A first reset member is provided between the sliding vane and the sliding vane groove. A lock groove in positional correspondence to a pin groove is provided on the sliding vane. A first cavity is formed between the sliding vane and the sliding vane groove. A second cavity is formed between a pin and the sliding vane. A third cavity is formed between the pin and the pin groove.

20 Claims, 10 Drawing Sheets

(51) Int. Cl.

| | |
|---|---|
| ***F25B 31/02*** | (2006.01) |
| ***F01C 21/08*** | (2006.01) |
| ***F25B 13/00*** | (2006.01) |
| ***F04C 28/06*** | (2006.01) |
| ***F04C 28/02*** | (2006.01) |
| ***F04C 23/00*** | (2006.01) |
| ***F25B 41/00*** | (2006.01) |
| *F01C 21/10* | (2006.01) |
| *F25B 41/04* | (2006.01) |
| *F24F 11/86* | (2018.01) |
| *F24F 5/00* | (2006.01) |

(52) U.S. Cl.
CPC ..... *F04C 23/008* (2013.01); *F04C 28/02* (2013.01); *F04C 28/06* (2013.01); *F04C 29/12* (2013.01); *F04C 29/124* (2013.01); *F25B 13/00* (2013.01); *F25B 31/023* (2013.01); *F25B 41/003* (2013.01); *F01C 21/108* (2013.01); *F24F 5/001* (2013.01); *F24F 11/86* (2018.01); *F25B 41/043* (2013.01); *F25B 2400/13* (2013.01); *F25B 2400/23* (2013.01); *F25B 2600/0261* (2013.01); *F25B 2600/2507* (2013.01)

(58) Field of Classification Search
CPC .... F04C 29/124; F01C 21/108; F25B 31/023; F25B 41/003; F25B 41/043; F25B 2400/13; F25B 2400/23; F25B 2600/0261; F25B 2600/507; F24F 5/001; F24F 11/86
See application file for complete search history.

(56) References Cited

FOREIGN PATENT DOCUMENTS

| | | | |
|---|---|---|---|
| CN | 105545752 | A | 5/2016 |
| CN | 205533258 | U | 8/2016 |
| JP | 2000130379 | A | 5/2000 |
| JP | 2000130380 | A | 5/2000 |

* cited by examiner

COMPRESSOR AND REFRIGERATION SYSTEM HAVING SAME

CROSS-REFERENCE TO RELATED APPLICATIONS

This application is the national stage entry of PCT/CN/2017/071966, filed on Jan. 20, 2017, which claims the benefit of priority to Chinese Patent Application No. 201610043991.0, filed Jan. 21, 2016, which are incorporated by reference in their entirety herein.

TECHNICAL FIELD

The present disclosure relates to a technical field of air conditioning devices, and more particularly to a compressor and a refrigeration system having the same.

BACKGROUND

The structure of a three-cylinder two-stage variable-capacity compressor in a related art is shown in FIG. 1 and FIG. 2, wherein a variable-capacity switching mode of the compressor is: the pressure at a tail of a pin 2' in the variable-capacity cylinder 1' is always a low pressure, and the pressure in a seal cavity (that is, a head of the pin 2') at a tail of a variable-capacity cylinder sliding vane groove 3' is a high pressure or a low pressure. When the tail of the variable-capacity cylinder sliding vane groove 3' is connected with the low pressure, a pressure of the head of the pin 2' is equal to a pressure of the tail of the pin 2', the pin 2' moves upward under an elastic force of a spring 4', and engages a sliding vane 5', the sliding vane 5' is locked, the variable-capacity cylinder 1' is unloaded, and at this time, the compressor is operated in two cylinders. When the tail of the variable-capacity cylinder sliding vane groove 3' is communicated with the high pressure, a pressure difference is formed between the head of the pin 2' and the tail of the pin 2', the pin 2' moves downward against the elastic force of the spring 4', the pin 2' is disengaged from the sliding vane 5', the sliding vane 5' can normally move, the variable-capacity cylinder 1' works, and at this time, the compressor is operated in three cylinders.

When the three-cylinder two-stage variable-capacity compressor adopts the above variable-capacity switching mode, an internal pressure of the variable-capacity cylinder 1' after unloaded is a low pressure, an internal pressure of a housing 6' is a high pressure, the pressure difference between an inside and outside of the variable-capacity cylinder 1' is large, refrigeration oil will enter into the variable-capacity cylinder 1' through a clearance between a lubrication passage of a crankshaft and a cylinder roller, and thus the refrigeration oil will be accumulated in the variable-capacity cylinder 1'. Therefore, when the compressor operation mode is switched from two-cylinder operation to three-cylinder operation, the variable-capacity cylinder 1' will compress the refrigeration oil. However, because the refrigeration oil is incompressible, the load of the compressor may suddenly increase, even causing over-current protection of a controller to result in shutdown, so there is a certain degree of reliability risk.

SUMMARY

Some embodiments of the present disclosure provide a compressor and a refrigeration system having the same, which may solve the problem in the conventional art of overloading of a variable-capacity cylinder of a compressor when restarted after unloading.

According to an aspect of the embodiments of the present disclosure, a compressor is provided. The compressor includes: a housing, and a lower flange structure, a first compression cylinder and a second compression cylinder, provided in the housing in a bottom-to-top sequence. The first compression cylinder is provided with a first suction port and a first exhaust port. The second compression cylinder is provided with a second suction port and a second exhaust port. The first exhaust port is communicated with the second suction port through a middle passage. A first control valve is provided in the middle passage. A pin groove is provided on the lower flange structure. A pin is provided in the pin groove. The first compression cylinder includes a cylinder body, a roller and a sliding vane. A sliding vane groove is provided on an inner wall of the cylinder body. The roller is provided in the cylinder body. The sliding vane is provided in the sliding vane groove and matched with the roller. A first reset member is provided between the sliding vane and the sliding vane groove. A lock groove in positional correspondence to the pin groove is provided on the sliding vane. A first cavity is formed between one end of the sliding vane oriented away from the roller and a bottom of the sliding vane groove. The cylinder body is provided with a first passage connecting the first cavity and the inner cavity of the housing. A second cavity is formed between a first end of the pin and the sliding vane. A third cavity is formed between a second end of the pin and a bottom of the pin groove. A second reset member is provided between the pin groove and the second end of the pin, the lower flange structure is provided with a second passage for connecting the first cavity and the second cavity. The compressor further includes: an intake pipeline, connected to the first suction port, a second control valve being provided on the intake pipeline; and a high pressure pipeline, a low pressure pipeline and a switching device, the high pressure pipeline and the low pressure pipeline being communicated with the third cavity through the switching device, and the switching device selectively connecting the high pressure pipeline or the low pressure pipeline to the third cavity.

In an exemplary embodiment, the compressor also includes a third compression cylinder provided above the second compression cylinder, and the third compression cylinder has a third suction port and a third exhaust port.

In an exemplary embodiment, the compressor also includes a first pipeline, a first end of the first pipeline is communicated with the third cavity, and the switching device selectively connects the first pipeline with the high pressure pipeline or the low pressure pipeline.

In an exemplary embodiment, both the high pressure pipeline and the low pressure pipeline are connected with a second end of the first pipeline, and the switching device includes: a third control valve, provided on the high pressure pipeline; and a fourth control valve, provided on the low pressure pipeline.

In an exemplary embodiment, the switching device is a three-way valve, and the first pipeline, the high pressure pipeline and the low pressure pipeline are all connected with the three-way valve.

In an exemplary embodiment, a fourth exhaust port is provided on the housing, and both ends of the high pressure pipeline are connected with the fourth exhaust port and a second end of the first pipeline respectively.

In an exemplary embodiment, the second control valve is a one-way valve, the compressor also includes a second pipeline, both ends of the second pipeline are connected with the intake pipeline and the first pipeline respectively, and a connection end of the second pipeline to the intake pipeline is located at a downstream part of the second control valve.

In an exemplary embodiment, the first reset member is a spring, a mounting hole is provided in the cylinder body, and the spring penetrates into the mounting hole, the mounting hole is a stepped through hole.

In an exemplary embodiment, the middle passage is provided outside the housing.

In an exemplary embodiment, the first control valve includes: a valve seat, provided with a valve port, an inner cone surface located below the valve port is provided in the valve seat; a valve core, provided in the valve seat, the valve core is provided with an outer cone surface matched with the inner cone surface; and a third reset member, provided between the valve seat and the valve core, wherein the valve core has an open position for opening the valve port and a closed position for closing the valve port, when the valve core is at the open position, the inner cone surface and the outer cone surface are separated, and when the valve core is at the closed position, the inner cone surface and the outer cone surface are contacted.

According to another aspect of the present disclosure, a refrigeration system is provided. The refrigeration system includes a compressor, a condenser, an evaporator and a gas-liquid separator connected in sequence. The compressor is the above compressor, and an intake pipeline of the compressor is connected with the gas-liquid separator.

In an exemplary embodiment, a low pressure pipeline of the compressor is connected with the evaporator.

By applying the technical solution of the present disclosure, since the first cavity and the second cavity of the compressor are both connected with the inner cavity of the housing, a tail of the sliding vane and a head of the pin are both in a high pressure environment. When the first compression cylinder needs to be unloaded, the high pressure pipeline is communicated with the third cavity through the switching device. At this time, both the head and the tail of the pin are in a high pressure environment, the pin moves toward the sliding vane under an action of the second reset member and matched with the lock groove, the sliding vane is locked, and the first compression cylinder is unloaded. At this time, the pressure environment in a variable-capacity cylinder is high pressure, so that refrigeration oil in the compressor does not enter into the first compression cylinder, thereby preventing the load from increasing when the first compression cylinder is started. When the first compression cylinder is required to operate, the low pressure pipeline is communicated with the third cavity through the switching device. At this time, the head of the pin is at a high pressure, and the tail is at a low pressure. The pin moves downward under pressure and leaves the sliding vane, and at this time, the sliding vane and the first compression cylinder operate normally. In addition, in order to ensure that the compressor can work normally when the first compression cylinder is unloaded, the first control valve is provided in the middle passage, the second control valve is provided on the intake pipeline, and when the first compression cylinder is unloaded, both the first control valve and the second control valve are closed, thereby preventing the first compression cylinder and the second compression cylinder from generating gas turbulence, and ensuring that the high pressure environment is always maintained in the first compression cylinder. Therefore, the technical solution of the present disclosure solves a problem in the related art of overloading of a variable-capacity cylinder of a compressor when restarted after unloading.

BRIEF DESCRIPTION OF THE DRAWINGS

The drawings of the description, forming a part of the present application, are used to provide a further understanding for the present disclosure. The schematic embodiments and illustrations of the present disclosure are used to explain the present disclosure, and do not form improper limits to the present disclosure. In the drawings.

The drawings include the following reference signs:

1', variable-capacity cylinder; 2', pin; 3', variable-capacity cylinder sliding vane groove; 4', spring; 5', sliding vane; 6', housing; 10, compressor; 20, condenser; 30, evaporator; 40, gas-liquid separator; 100, housing; 110, fourth exhaust port; 200, first compression cylinder; 210, first suction port; 220, first exhaust port; 230, cylinder body; 231, sliding vane groove; 232, mounting hole; 240, lower flange structure; 241, pin groove; 250, roller; 260, sliding vane; 261, lock groove; 271, first reset member; 272, second reset member; 281, first cavity; 282, second cavity; 283, third cavity; 290, pin; 300, second compression cylinder; 310, second suction port; 320, second exhaust port 400, third compression cylinder; 410, third exhaust port; 500, middle passage; 600, first control valve; 610, valve seat; 611, valve port; 612, inner cone surface; 620, valve core; 621, outer cone surface; 630, third reset member; 700, intake pipeline; 800, second control valve; 900, high pressure pipeline; 1000, low pressure pipeline; 1100, switching device; 1101, third control valve; 1102, fourth control valve; 1200, first pipeline; 1300, second pipeline.

DETAILED DESCRIPTION OF THE EMBODIMENTS

It should be noted that embodiments in the present application and characteristics in the embodiments may be combined under the condition of no conflicts. The present disclosure will be illustrated herein below with reference to the drawings and in conjunction with the embodiments in detail.

Figure 5:
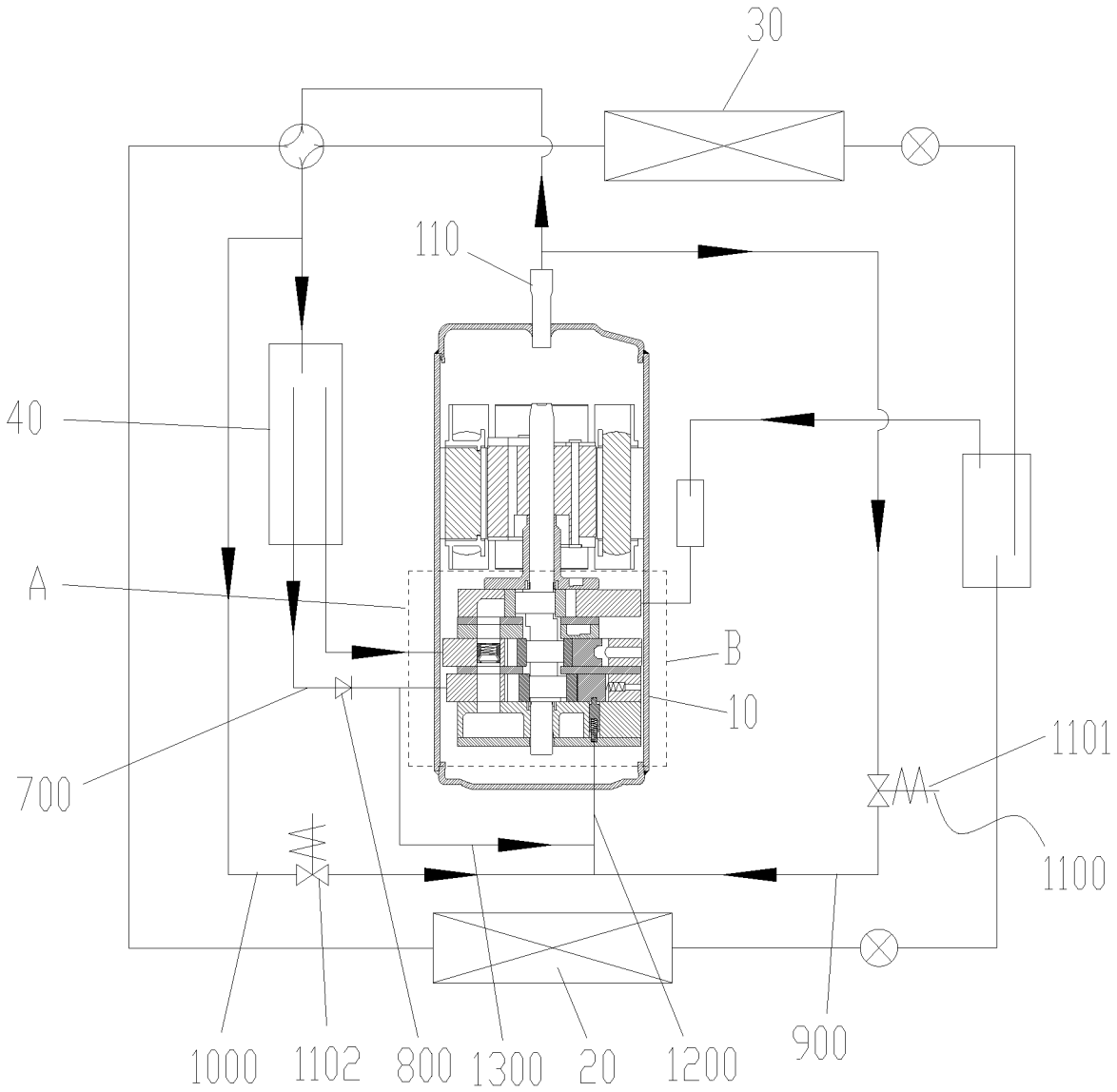
FIG. 5 shows a structural schematic view of an embodiment of a refrigeration system and a compressor according to the present disclosure.
Figure 6:
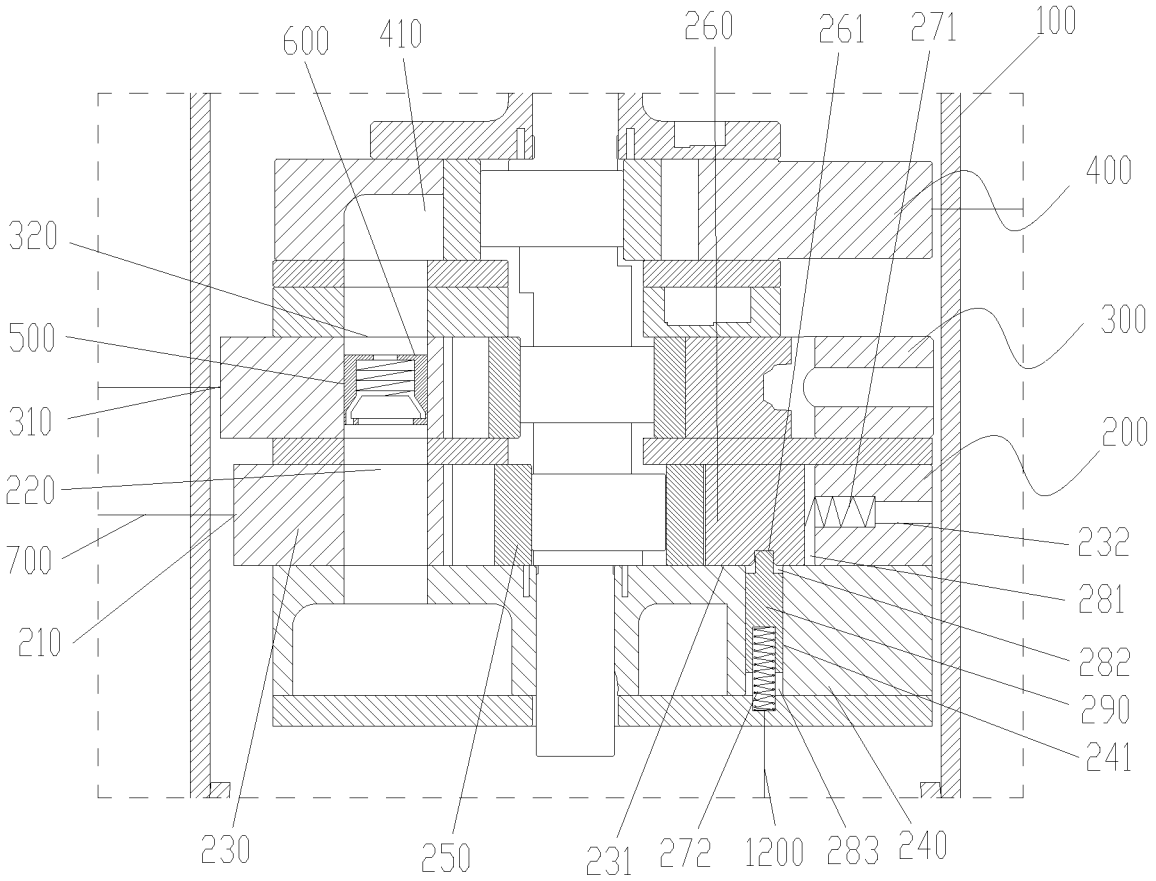
FIG. 6 shows an enlarged schematic view of B of the compressor in FIG. 5.

As shown in FIG. 5 and FIG. 6, a compressor of the present embodiment includes a housing 100, and a lower flange structure 240, a first compression cylinder 200 and a second compression cylinder 300, provided in the housing 100 in a bottom-to-top sequence. Wherein, the first compression cylinder 200 is provided with a first suction port 210 and a first exhaust port 220. The second compression cylinder 300 is provided with a second suction port 310 and a second exhaust port 320. The first exhaust port 220 is communicated with the second suction port 310 through a middle passage 500. A first control valve 600 is provided in the middle passage 500. A pin groove 241 is provided on the lower flange structure 240. A pin 290 is provided in the pin groove 241.

The first compression cylinder 200 includes a cylinder body 230, a roller 250 and a sliding vane 260. Wherein, a sliding vane groove 231 is provided on an inner wall of the cylinder body 230. The roller 250 is provided in the cylinder body 230. The sliding vane 260 is provided in the sliding vane groove 231 and matched with the roller 250. A first reset member 271 is provided between the sliding vane 260 and the sliding vane groove 231. A lock groove 261 in positional correspondence to the pin groove 241 is provided on the sliding vane 260. A first cavity 281 is formed between one end of the sliding vane 260 far away from the roller 250 and a bottom of the sliding vane groove 231. The cylinder body 230 is provided with a first passage communicating the first cavity 281 with an inner cavity of the housing 100. A second cavity 282 is formed between a first end of the pin 290 and the sliding vane 260. A third cavity 283 is formed between a second end of the pin 290 and a bottom of the pin groove 241. A second reset member 272 is provided between the pin groove 241 and the second end of the pin 290. A second passage is provided on the lower flange structure 240 to communicate with the first cavity 281 and the second cavity 282.

The compressor in the embodiment 1 further includes an intake pipeline 700, a high pressure pipeline 900, a low pressure pipeline 1000 and a switching device 1100, the intake pipeline 700 is connected with the first suction port 210, a second control valve 800 is provided on the intake pipeline 700; the high pressure pipeline 900 and the low pressure pipeline 1000 are communicated with the third cavity 283 through the switching device 1100, and the switching device 1100 selectively connecting the high pressure pipeline 900 or the low pressure pipeline 1000 to the third cavity 283.

It should be noted that the first compression cylinder 200 in the embodiment 1 is a variable-capacity cylinder.

By applying a technical solution of the present disclosure, since the first cavity 281 and the second cavity 282 of the compressor are communicated with the inner cavity of the housing 100, a tail of the sliding vane 260 and a head of the pin 290 are both in a high pressure environment. When the first compression cylinder 200 needs to be unloaded, the high pressure pipeline 900 is communicated with the third cavity 283 through the switching device 1100. At this time, both the head and a tail of the pin 290 are in a high pressure environment, the pin 290 moves toward the sliding vane 260 under an action of the second reset member 272 and matches with the lock groove 261, the sliding vane 260 is locked, and the first compression cylinder 200 is unloaded. At this time, a pressure in a variable-capacity cylinder is a high pressure, so that refrigeration oil in the compressor does not enter into the first compression cylinder 200, thereby preventing the load from increasing when the first compression cylinder 200 is started. When the first compression cylinder 200 is required to operate, the low pressure pipeline 1000 is communicated with the third cavity 283 through the switching device 1100. At this time, the head of the pin 290 is at a high pressure, and the tail is at a low pressure. The pin 290 moves downward under pressure and leaves the sliding vane 260, and at this time, the sliding vane 260 and the first compression cylinder 200 operate normally. In addition, in order to ensure that the compressor can work normally when the first compression cylinder 200 is unloaded, a first control valve 600 is provided in the middle passage 500, a second control valve 800 is provided on the intake pipeline 700, and when the first compression cylinder 200 is unloaded, both the first control valve 600 and the second control valve 800 are closed, thereby preventing the first compression cylinder 200 and the second compression cylinder 300 from generating gas turbulence, and ensuring that the high pressure environment is always maintained in the first compression cylinder 200. Therefore, the technical solution of the present embodiment solves a problem in the related art of overloading of a variable-capacity cylinder of a compressor when restarted after unloading.

Figure 1:
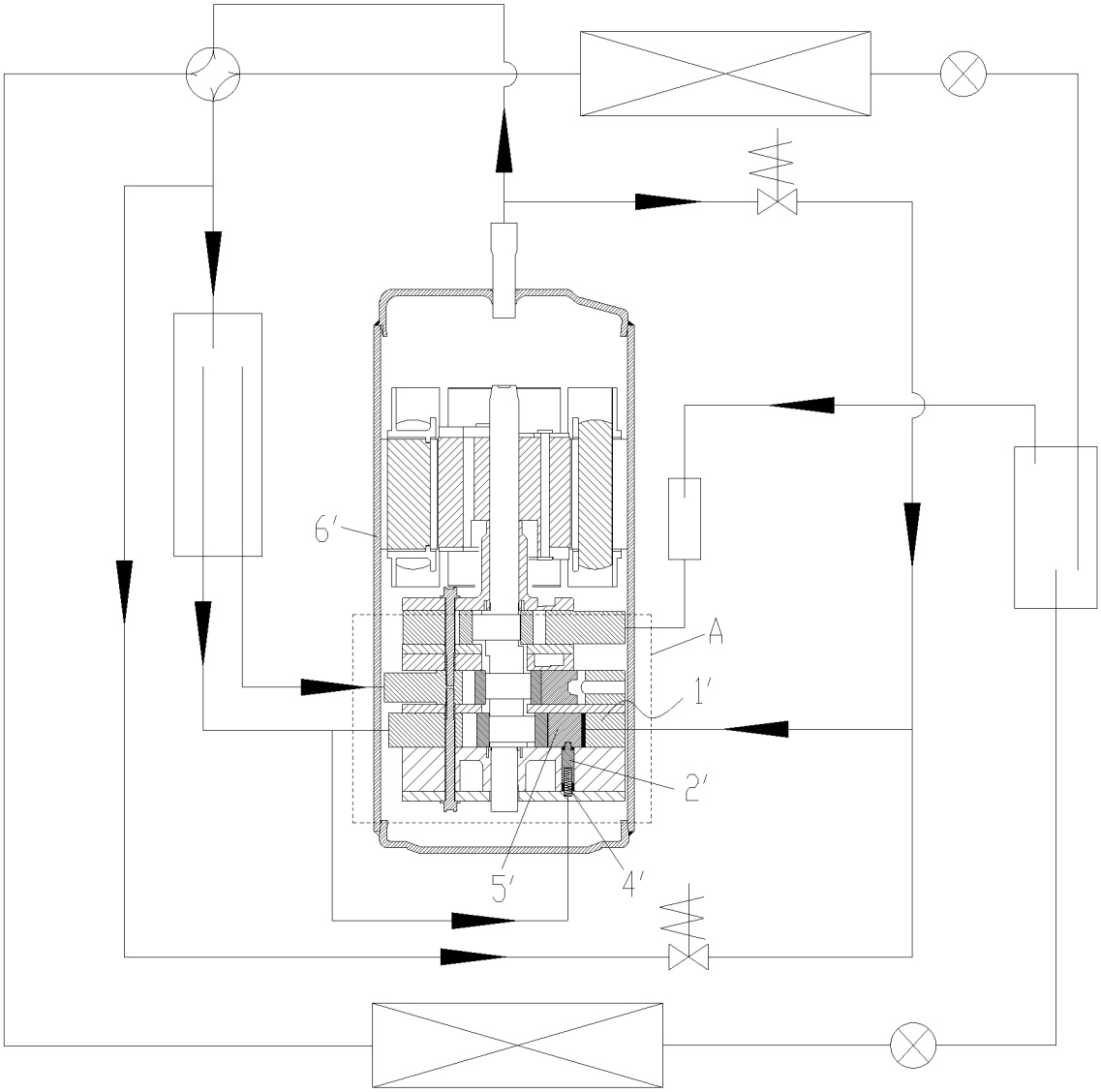
FIG. 1 shows a structural schematic view of a compressor in the related art.
Figure 2:
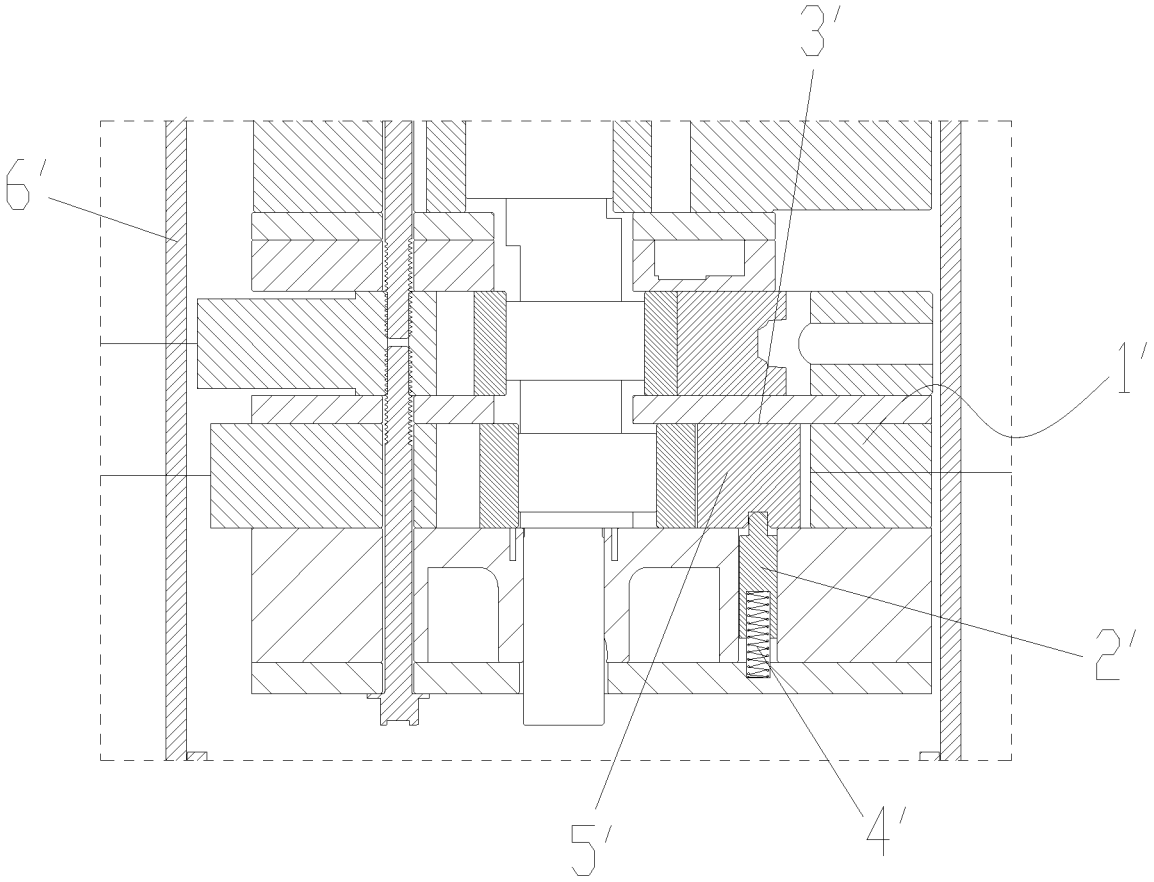
FIG. 2 shows an enlarged schematic view of A of the compressor in FIG. 1.
Figure 3:
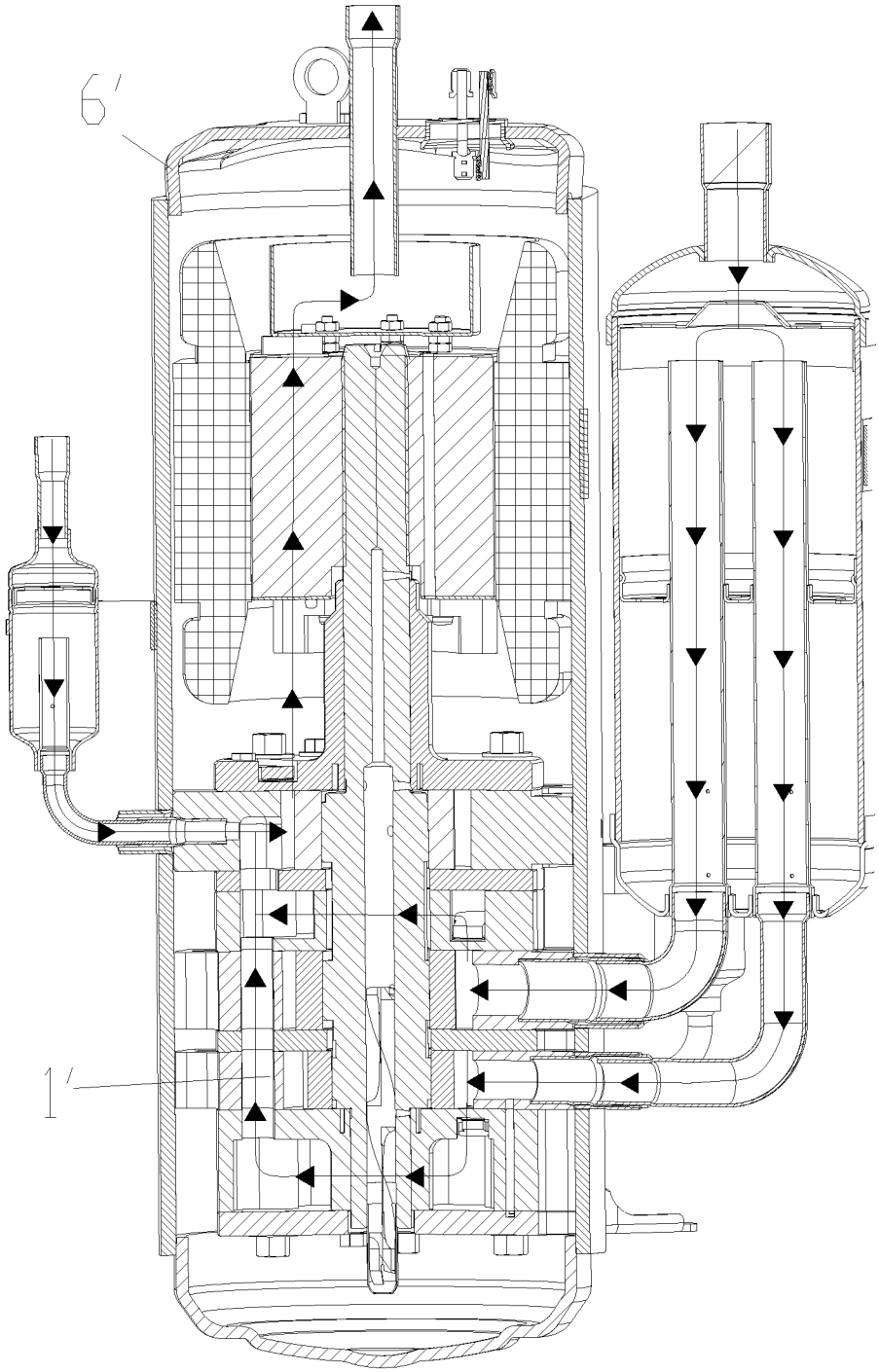
FIG. 3 shows a schematic view of a flowing direction of refrigerant when the compressor in FIG. 1 is in a three-cylinder working state.
Figure 4:
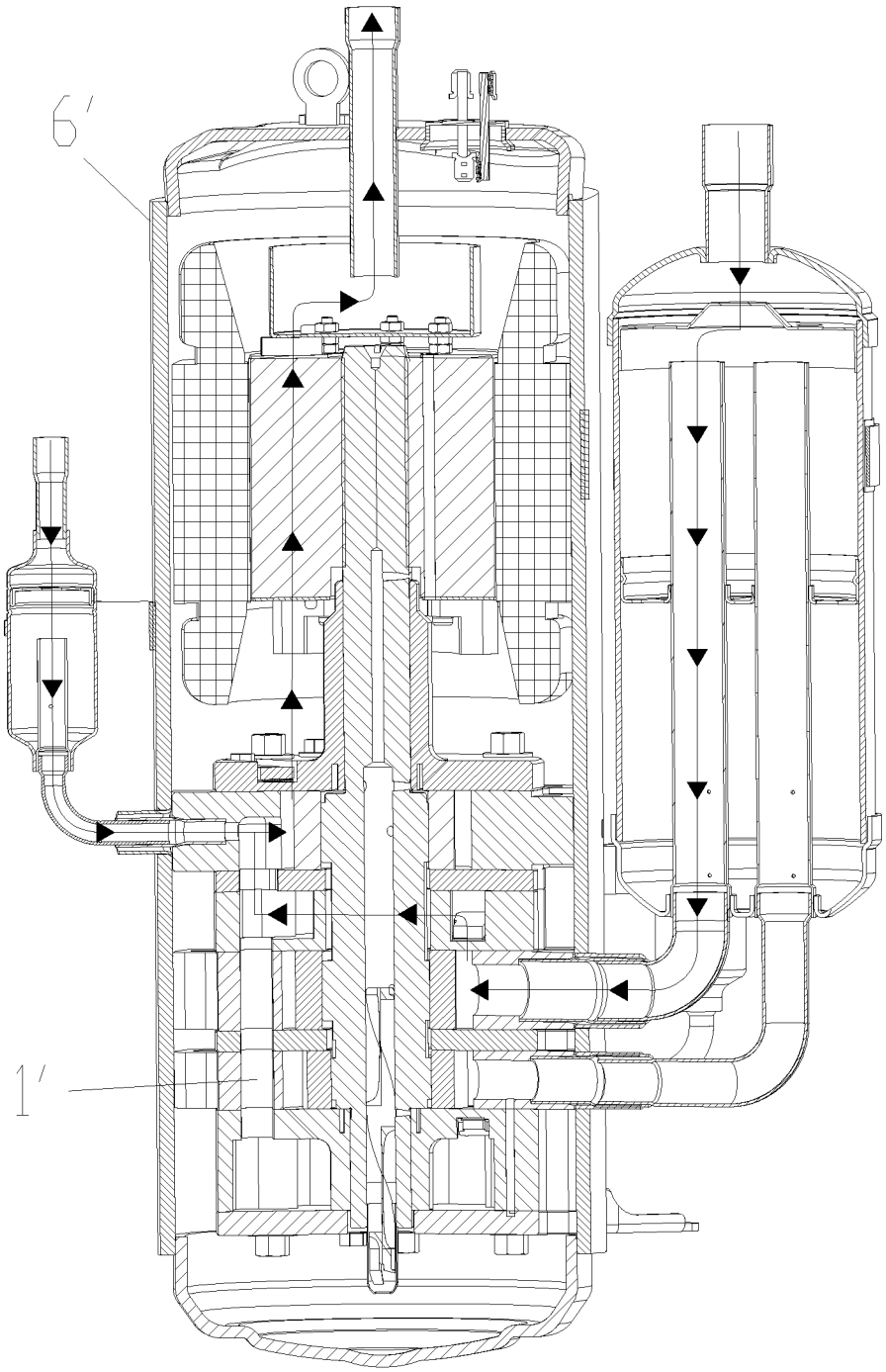
FIG. 4 shows a schematic view of a flowing direction of refrigerant when the compressor in FIG. 1 is in a two-cylinder working state.

As shown in FIG. 5 and FIG. 6, in the technical solution of the embodiment 1, the compressor further includes a third compression cylinder 400 provided above the second compression cylinder 300, and the third compression cylinder 400 is provided with a third suction port and a third exhaust port 410. The above structure constitutes a three-stage compressor while the first compression cylinder 200 is a variable-capacity cylinder. The three-stage compressor of the embodiment 1 can solve the problem in the related art that a middle cylinder of the three-stage compressor is prone to turbulence, as follows:

The internal refrigerant flow of a three-cylinder two-stage variable-capacity compressor in the related art is shown in FIG. 3 and FIG. 4. When the compressor is operated in a two cylinders, the middle cylinder is exhausted upward and downward intermittently. The suction volume of a high-pressure cylinder is not constant (the cylinder volume changes periodically). When the suction volume of the high-pressure cylinder is small, the exhaust of the middle cylinder will move in a middle cavity of a lower flange, thereby increasing the middle flow loss of refrigerant.

In the technical solution of the embodiment 1, when the first compression cylinder 200 is unloaded, the first control valve 600 located in the middle passage 500 is closed, so that an exhaust gas of the second compression cylinder 300 cannot be discharged into the first compression cylinder 200. At this time, the exhaust gas of the second compression cylinder 300 is only discharged upward, and no turbulence phenomenon occurs. Therefore, the technical solution of the embodiment 1 also solves the problem in the related art that the middle cylinder of the three-stage compressor is prone to produce turbulence As shown in FIG. 5, in the technical solution of the embodiment 1, the compressor also includes a first pipeline 1200, a first end of the first pipeline 1200 is communicated with the third cavity 283, the switching device 1100 is provided between the first pipeline 1200, the high pressure pipeline 900 and the low pressure pipeline 1000, and the switching device 1100 selectively connects the first pipeline 1200 to the high pressure pipeline 900 or connects the first pipeline 1200 to the low pressure pipeline 1000. As mentioned above, the high pressure pipeline 900 and the low pressure pipeline 1000 are converged, and then enter into the housing 100 through the first pipeline 1200, so that the pipeline arrangement can be simplified.

As shown in FIG. 5, in the technical solution of the embodiment 1, both the high pressure pipeline 900 and the low pressure pipeline 1000 are connected with a second end of the first pipeline 1200, and the switching device 1100 includes a third control valve 1101 and a fourth control valve 1102. The third control valve 1101 is provided on the high pressure pipeline 900, and the fourth control valve 1102 is provided on the low pressure pipeline 1000. Specifically, the third control valve 1101 and the fourth control valve 1102 are both solenoid valves. When it is desired to provide a high pressure environment in the third cavity 283 at the tail of the pin 290, the third control valve 1101 is opened and the fourth control valve 1102 is closed, and the high pressure pipeline 900 is communicated with the third cavity 283. When it is desired to provide a low pressure environment in the third cavity 283 at the tail of the pin 290, the third control valve 1101 is closed and the fourth control valve 1102 is opened, and the low pressure pipeline 1000 is communicated with the third cavity 283.

As shown in FIG. 5, in the technical solution of the embodiment 1, a fourth exhaust port 110 is provided on the housing 100, and both ends of the high pressure pipeline 900 are connected with the fourth exhaust port 110 and a second end of the first pipeline 1200 respectively. The above structure provides a high pressure environment for the high pressure pipeline 900 through an own structure of the compressor. Of course, the high pressure pipeline 900 is also connected with other high pressure environments.

As shown in FIG. 5, in the technical solution of the embodiment 1, the second control valve 800 is a one-way valve, the compressor also includes a second pipeline 1300, both ends of the second pipeline 1300 are connected with the intake pipeline 700 and the first pipeline 1200 respectively, and a connection end between the second pipeline 1300 and the intake pipeline 700 is located at a downstream part of the second control valve 800. The above structure realizes the opening and closing of the second control valve 800 by pressure control. Specifically, when the first compression cylinder 200 is unloaded, that is, the high pressure pipeline 900 is turned on, the downstream part of the second control valve 800 is in a high pressure environment, and an upstream part (that is, a suction side) of the second control valve 800 is in a low pressure environment. At this time, a downstream pressure of the one-way valve is greater than an upstream pressure, and the one-way valve is cut off. The lower suction pressure cannot enter the first compression cylinder 200, and thus an internal pressure of the first compression cylinder 200 is always high when it is unloaded. When the first compression cylinder 200 is operated, that is, the low pressure pipeline 1000 is turned on, both sides of the second control valve 800 are in a low pressure environment. At this time, the one-way valve is normally turned on, and the first compression cylinder 200 normally sucks gas.

Of course, the second control valve 800 may also be a solenoid valve. When the first compression cylinder 200 is unloaded, the second control valve 800 is closed. When the second compression cylinder 300 is operated, the second control valve 800 is opened.

As shown in FIG. 6, in the technical solution of the embodiment 1, the first reset member 271 is a spring, a mounting hole 232 is provided in the cylinder body 230, and the spring penetrates into the mounting hole 232, the mounting hole 232 is a stepped through hole. The above mounting hole 232 is the above first passage.

Figure 7:
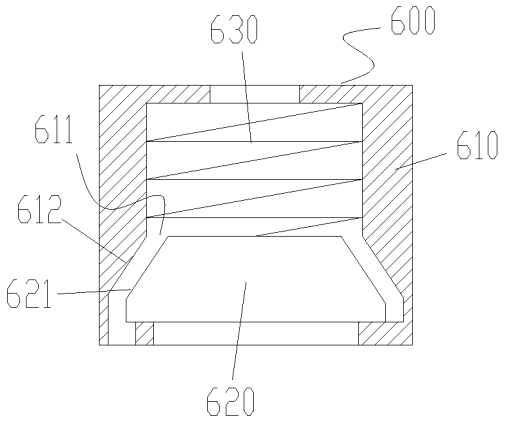
FIG. 7 shows a structural schematic view of a first control valve of the compressor in FIG. 5.

As shown in FIG. 7, in the technical solution of the embodiment 1, the first control valve 600 includes a valve seat 610, a valve core 620 and a third reset member 630. Wherein, the valve seat 610 is provided with a valve port 611, an inner cone surface 612 located below the valve port 611 is provided in the valve seat 610. The valve core 620 is provided in the valve seat 610, the valve core 620 is provided with an outer cone surface 621 matched with the inner cone surface 612. The third reset member 630 is provided between the valve seat 610 and the valve core 620. The valve core 620 is provided with an open position for opening the valve port 611 and a closed position for closing the valve port 611, when the valve core 620 is at the open position, the inner cone surface 612 and the outer cone surface 621 are separated, and when the valve core 620 is at the closed position, the inner cone surface 612 and the outer cone surface 621 are contacted.

When the first compression cylinder 200 is unloaded, a pressure environment in the first compression cylinder 200 is a high pressure environment, that is, a lower side of the valve core 620 is a high pressure environment, and an upper side of the valve core 620 is a medium pressure environment. At this time, the valve core 620 is lifted up and closes the valve port 611. At this time, the exhaust gas of the second compression cylinder 300 cannot enter into the first compression cylinder 200. When the first compression cylinder 200 is in operation, both sides of the valve core 620 are in an intermediate pressure environment. At this time, the valve core 620 opens the valve port 611 under an action of the third reset member 630, and the exhaust gas of the second compression cylinder 300 enters into the first compression cylinder 200 normally.

Figure 8:
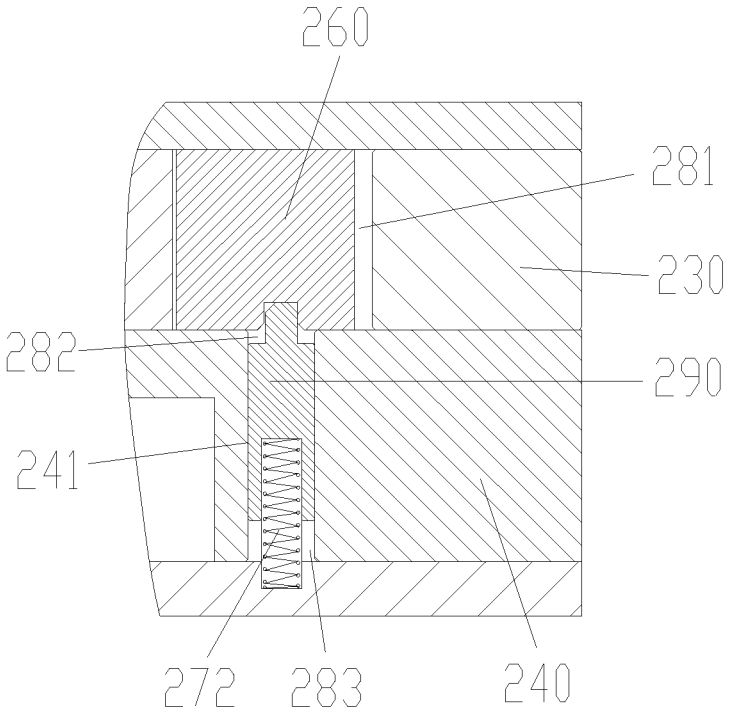
FIG. 8 shows a structure fitting schematic view of a pin and a sliding vane when a first cylinder body of the compressor in FIG. 5 is unloaded.

From the above, it can be seen that the compressor of the embodiment 1 is provided with two working states, specifically:

Partial-load working state: as shown in FIG. 5, FIG. 6 and FIG. 8, the third control valve 1101 is opened, the fourth control valve 1102 is closed, and the high pressure gas at a exhaust side of the compressor enters into the third cavity 283 through the third control valve 1101, the first control valve 600 is in a cut-off state, the second control valve 800 is in a cut-off state, the upper and lower ends of the pin 290 are both in a high pressure environment, the upper end of the pin 290 is locked in the lock groove 261 of the variable-capacity cylinder sliding vane 260, the sliding vane 260 of the first compression cylinder 200 is in a locked state, and the first compression cylinder 200 runs idle. Since an inside of the first compression cylinder 200 is at a high pressure, which is equal to the pressure in the housing 100, there is no large pressure difference, and refrigeration oil is unlikely to accumulate in the variable-capacity cylinder.

Figure 9:
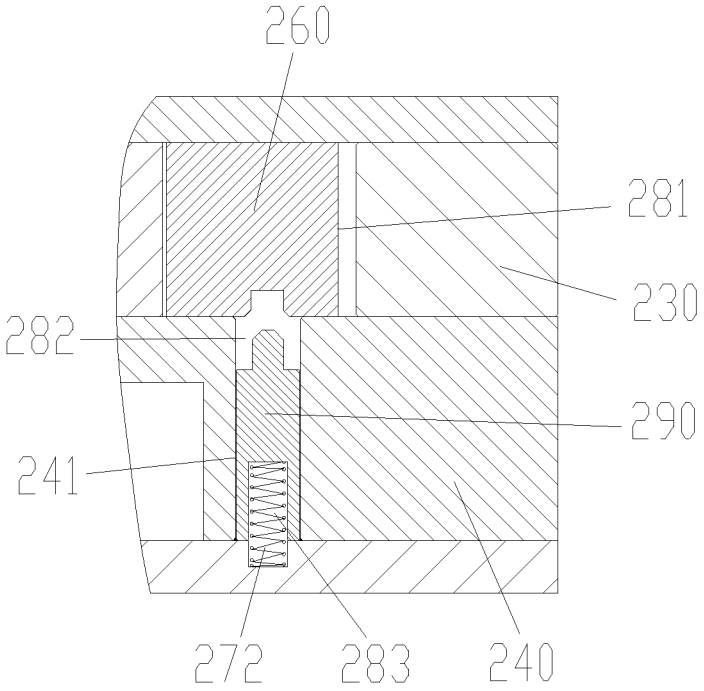
FIG. 9 shows a structure fitting schematic view of a pin and a sliding vane when a first cylinder body of the compressor in FIG. 5 works.

Full-load working state: as shown in FIG. 5, FIG. 6 and FIG. 9, the third control valve 1101 is closed, the fourth control valve 1102 is opened, and the low pressure gas at a suction side of the compressor enters the third cavity 283 through the fourth control valve 1102, the first control valve 600 is in a turn-on state, the second control valve 800 is in a turn-on state, the upper end of the pin 290 is high pressure, the lower end of the pin 290 is low pressure, the sliding vane 260 of the first compression cylinder 200 is in a free sliding state, the lower end of the pin 290 is abuts against the lower flange structure 240, and the first compression cylinder 200 performs normal compression operation.

The working principle of switching the partial-load state to the full-load state is as follows: the fourth control valve 1102 is opened, the third control valve 1101 is closed, low pressure gas is introduced into the variable-capacity cylinder and the tail of the pin 290, the head of the sliding vane 260 of the variable-capacity cylinder is at a low pressure environment, the tail of the sliding vane 260 of the variable-capacity cylinder is at a high pressure environment, a lower portion of the pin 290 of a variable-capacity control mechanism is at a low pressure environment, and an upper portion of the pin 290 is at a high pressure environment. The pressure at the lower end of the first control valve 600 is lowered from high pressure to low pressure, and the upper end is medium pressure. There is no pressure difference between the upper and lower ends of the valve core. Under an action of the pressure difference between the upper and lower ends and the elastic force of the spring, the valve core 620 moves downward. The middle passage 500 is opened, and gas may pass through the first control valve 600 normally. Meanwhile, the pin 290 moves downward against the elastic force of the variable-capacity spring under the pressure difference between the upper and lower ends until the lower end of the pin 290 is pressed against the lower flange structure 240. At this time, the sliding vane 260 of the variable-capacity cylinder is in a free state, and normal sliding can be achieved. The sliding vane 260 of the variable-capacity cylinder slides under the pressure difference between the tail and the head until it is in close contact with the roller 250 of the variable-capacity cylinder, and the variable-capacity cylinder is divided into two chambers. With a rotation of the compressor, the pressure of the chamber at the suction side of the variable-capacity cylinder decreases, and a pressure difference occurs between a front and rear ends of the second control valve 800 at the intake pipeline 700 of the variable volume cylinder. The second control valve 800 is switched from an off state to an on state, the variable volume cylinder sucks a low pressure gas refrigerant and realizes compression operation, and the system enters the full-load working state.

The working principle of switching the full-load state to the partial-load state is as follows: the fourth control valve 1102 is closed, the third control valve 1101 is opened, a high pressure gas is introduced into the variable-capacity cylinder and the tail of the pin 290, the head of the sliding vane 260 of the variable-capacity cylinder is at a high pressure environment, the tail of the sliding vane 260 of the variable-capacity cylinder is at a high pressure environment, the lower portion of the pin 290 of a variable-capacity control mechanism is at a high pressure environment, and the upper portion of the pin 290 is at a high pressure environment. There is no pressure difference between the upper and lower portions of the pin 290. The pin 290 moves upward against a gravity of the pin 290 under the elastic force of the variable-capacity spring until the upper end of the pin 290 is pushed into the lock groove 261 of the sliding vane 260, and the sliding vane 260 is locked. At this time, the sliding vane 260 is changed from a free state to a locked state, sliding cannot be achieved, and the sliding vane 260 is disengaged from the variable-capacity cylinder roller 250. The second control valve 800 at the variable-capacity-cylinder intake pipeline 700 has a high pressure at the rear end and a low pressure at the front end, a reverse pressure difference exists between the front and rear ends of the second control valve 800, and the second control valve 800 is switched from an on state to an off state, the variable-capacity cylinder cannot normally suck gas, and the variable-capacity cylinder achieves idling. Meanwhile, the lower end of the first control valve 600 is at a high pressure environment, the upper end is at a medium pressure environment, the pressures on the upper and lower ends of the valve core are not equal, the valve core 620 moves upward against the elastic force of the spring under the pressure difference between the upper and lower ends until the middle passage 500 is closed, and thus, the system enters the partial-load working state.

Figure 10:
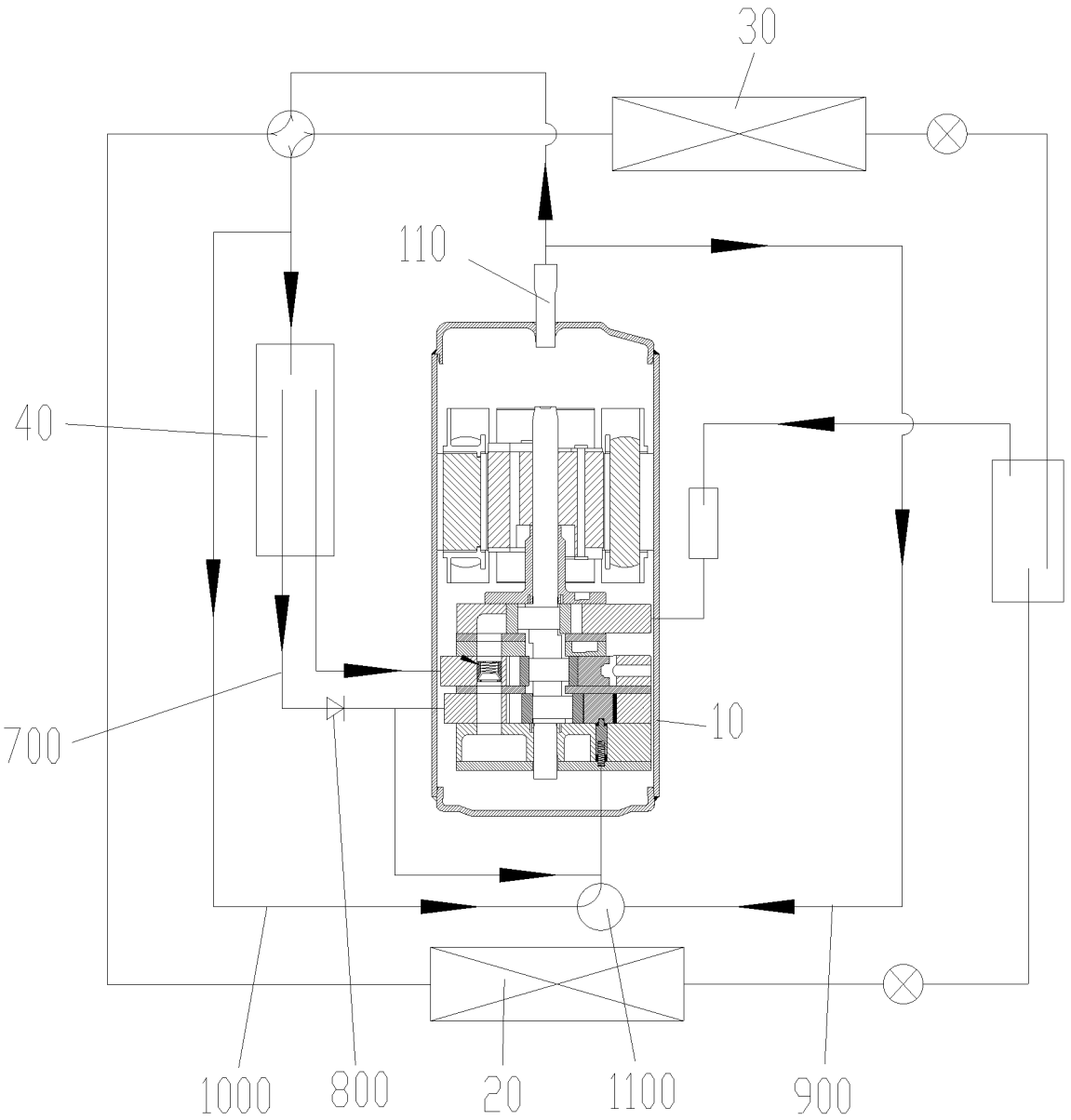
FIG. 10 shows a structural schematic view of an embodiment 2 of a refrigeration system and a compressor according to the present disclosure.

As shown in FIG. 10, the embodiment 2 of the compressor according to the present application is different from the embodiment 1 in that the middle passage 500 is provided outside the housing 100. The control mode of the compressor in the embodiment 2 is the same as the control mode of the compressor in the embodiment 1, which will not be described here.

Figure 11:
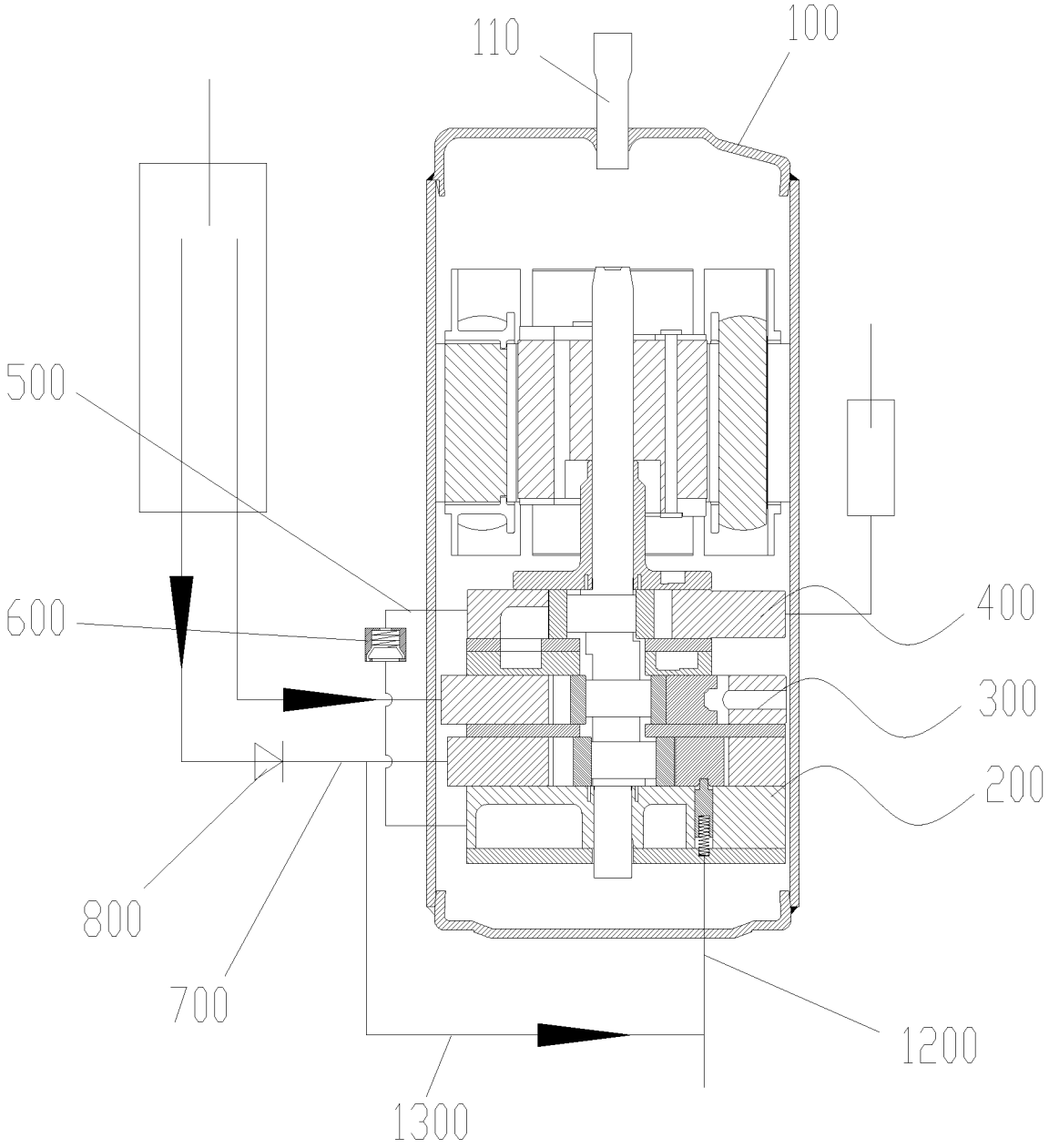
FIG. 11 shows a structural schematic view of an embodiment 3 of a refrigeration system and a compressor according to the present disclosure.

As shown in FIG. 11, according to the embodiment 3 of the compressor according to the present application is different from the embodiment 1 in that the switching device 1100 is a three-way valve, and the first pipeline 1200, the high pressure pipeline 900 and the low pressure pipeline 1000 are all connected with the three-way valve. The control mode of the compressor in the embodiment 3 is the same as the control mode of the compressor in the embodiment 1, which will not be described here.

The present application also provides a refrigeration system. The embodiment of the refrigeration system according to the present application includes a compressor 10, a condenser 20, an evaporator 30 and a gas-liquid separator 40, connected in sequence. The compressor 10 is the above compressor, and an intake pipeline 700 of the compressor 10 is connected with the gas-liquid separator 40. Meanwhile, a low pressure pipeline 1000 of the compressor is connected with the evaporator 30. The evaporator 30 provides a low pressure environment for the low pressure pipeline 1000.

The above is only the preferable embodiments of the present disclosure, and not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A compressor, comprising:

a housing (100), and a lower flange structure (240), a first compression cylinder (200) and a second compression cylinder (300), provided in the housing (100) in a bottom-to-top sequence, wherein the first compression cylinder (200) is provided with a first suction port (210) and a first exhaust port (220), the second compression cylinder (300) is provided with a second suction port (310) and a second exhaust port (320), the first exhaust port (220) is communicated with the second suction port (310) through a middle passage (500), a first control valve (600) is provided in the middle passage (500), a pin groove (241) is provided on the lower flange structure (240), and a pin (290) is provided in the pin groove (241);

wherein the first compression cylinder (200) comprises a cylinder body (230), a roller (250) and a sliding vane (260), a sliding vane groove (231) is provided on an inner wall of the cylinder body (230), the roller (250) is provided in the cylinder body (230), the sliding vane (260) is provided in the sliding vane groove (231) and matched with the roller (250), a first reset member (271) is provided between the sliding vane (260) and the sliding vane groove (231), a lock groove (261) in positional correspondence to the pin groove (241) is provided on the sliding vane (260), a first cavity (281) is formed between one end of the sliding vane (260)

oriented away from the roller (250) and a bottom of the sliding vane groove (231), the cylinder body (230) is provided with a first passage connecting the first cavity (281) and an inner cavity of the housing (100);

a second cavity (282) is formed between a first end of the pin (290) and the sliding vane (260), a third cavity (283) is formed between a second end of the pin (290) and a bottom of the pin groove (241), a second reset member (272) is provided between the pin groove (241) and the second end of the pin (290), the lower flange structure (240) is provided with a second passage for connecting the first cavity (281) and the second cavity (282), the compressor further comprising:

an intake pipeline (700), connected to the first suction port (210), a second control valve (800) being provided on the intake pipeline (700); and a high pressure pipeline (900), a low pressure pipeline (1000) and a switching device (1100), the high pressure pipeline (900) and the low pressure pipeline (1000) being communicated with the third cavity (283) through the switching device (1100), and the switching device (1100) selectively connecting the high pressure pipeline (900) or the low pressure pipeline (1000) to the third cavity (283).

2. The compressor as claimed in claim 1, wherein the compressor further comprises a third compression cylinder (400) provided above the second compression cylinder (300), and the third compression cylinder (400) has a third suction port and a third exhaust port (410).

3. The compressor as claimed in claim 1, wherein the compressor further comprises a first pipeline (1200), wherein a first end of the first pipeline (1200) is communicated with the third cavity (283), and the switching device (1000) selectively connects the first pipeline (1200) with the high pressure pipeline (900) or the low pressure pipeline (1000).

4. The compressor as claimed in claim 3, wherein both the high pressure pipeline (900) and the low pressure pipeline (1000) are connected with a second end of the first pipeline (1200), and the switching device (1100) comprises:

a third control valve (1101), provided on the high pressure pipeline (900); and a fourth control valve (1102), provided on the low pressure pipeline (1000).

5. The compressor as claimed in claim 3, wherein the switching device (1100) is a three-way valve, and the first pipeline (1200), the high pressure pipeline (900) and the low pressure pipeline (1000) are all connected with the three-way valve.

6. The compressor as claimed in claim 3, wherein a fourth exhaust port (110) is provided on the housing (100), and both ends of the high pressure pipeline (900) are connected with the fourth exhaust port (110) and a second end of the first pipeline (1200) respectively.

7. The compressor as claimed in claim 3, wherein the second control valve (800) is a one-way valve, the compressor further comprises a second pipeline (1300), both ends of the second pipeline (1300) are connected with the intake pipeline (700) and the first pipeline (1200) respectively, and a connection end of the second pipeline (1300) to the intake pipeline (700) is located at a downstream part of the second control valve (800).

8. The compressor as claimed in claim 1, wherein the first reset member (271) is a spring, a mounting hole (232) is provided in the cylinder body (230), and the spring penetrates into the mounting hole (232), the mounting hole (232) is a stepped through hole.

9. The compressor as claimed in claim 1, wherein the middle passage (500) is provided outside the housing (100).

10. The compressor as claimed in claim 1, wherein the first control valve (600) comprises:

a valve seat (610), provided with a valve port (611), an inner cone surface (612) located below the valve port (611) is provided in the valve seat (610);

a valve core (620), provided in the valve seat (610), the valve core (620) is provided with an outer cone surface (621) matched with the inner cone surface (612); and a third reset member (630), provided between the valve seat (610) and the valve core (620), wherein the valve core (620) is provided with an open position for opening the valve port (611) and a closed position for closing the valve port (611), when the valve core (620) is at the open position, the inner cone surface (612) and the outer cone surface (621) are separated, and when the valve core (620) is at the closed position, the inner cone surface (612) and the outer cone surface (621) are contacted.

11. A refrigeration system, comprising a compressor (10), a condenser (20), an evaporator (30) and a gas-liquid separator (40) connected in sequence, wherein the compressor (10) is the compressor as claimed in claim 1, and an intake pipeline (700) of the compressor (10) is connected with the gas-liquid separator (40).

12. The refrigeration system as claimed in claim 11, wherein a low pressure pipeline (1000) of the compressor is connected with the evaporator (30).

13. The compressor as claimed in claim 9, wherein the first control valve (600) comprises:

a valve seat (610), provided with a valve port (611), an inner cone surface (612) located below the valve port (611) is provided in the valve seat (610);

a valve core (620), provided in the valve seat (610), the valve core (620) is provided with an outer cone surface (621) matched with the inner cone surface (612); and a third reset member (630), provided between the valve seat (610) and the valve core (620), wherein the valve core (620) is provided with an open position for opening the valve port (611) and a closed position for closing the valve port (611), when the valve core (620) is at the open position, the inner cone surface (612) and the outer cone surface (621) are separated, and when the valve core (620) is at the closed position, the inner cone surface (612) and the outer cone surface (621) are contacted.

14. A refrigeration system, comprising a compressor (10), a condenser (20), an evaporator (30) and a gas-liquid separator (40) connected in sequence, wherein the compressor (10) is the compressor as claimed in claim 2, and an intake pipeline (700) of the compressor (10) is connected with the gas-liquid separator (40).

15. A refrigeration system, comprising a compressor (10), a condenser (20), an evaporator (30) and a gas-liquid separator (40) connected in sequence, wherein the compressor (10) is the compressor as claimed in claim 3, and an intake pipeline (700) of the compressor (10) is connected with the gas-liquid separator (40).

16. A refrigeration system, comprising a compressor (10), a condenser (20), an evaporator (30) and a gas-liquid separator (40) connected in sequence, wherein the compressor (10) is the compressor as claimed in claim 4, and an intake pipeline (700) of the compressor (10) is connected with the gas-liquid separator (40).

17. A refrigeration system, comprising a compressor (10), a condenser (20), an evaporator (30) and a gas-liquid separator (40) connected in sequence, wherein the compressor (10) is the compressor as claimed in claim 5, and an intake pipeline (700) of the compressor (10) is connected with the gas-liquid separator (40).

18. A refrigeration system, comprising a compressor (10), a condenser (20), an evaporator (30) and a gas-liquid separator (40) connected in sequence, wherein the compressor (10) is the compressor as claimed in claim 6, and an intake pipeline (700) of the compressor (10) is connected with the gas-liquid separator (40).

19. A refrigeration system, comprising a compressor (10), a condenser (20), an evaporator (30) and a gas-liquid separator (40) connected in sequence, wherein the compressor (10) is the compressor as claimed in claim 7, and an intake pipeline (700) of the compressor (10) is connected with the gas-liquid separator (40).

20. A refrigeration system, comprising a compressor (10), a condenser (20), an evaporator (30) and a gas-liquid separator (40) connected in sequence, wherein the compressor (10) is the compressor as claimed in claim 8, and an intake pipeline (700) of the compressor (10) is connected with the gas-liquid separator (40).

* * * * *